US011826878B2

(12) United States Patent
Wang et al.

(10) Patent No.: US 11,826,878 B2
(45) Date of Patent: Nov. 28, 2023

(54) RIGID-FLEXIBLE COUPLING-DRIVEN ROBOT FOR REMOVING OXIDE SCALES ON SUPER LARGE SHAFT FORGINGS ONLINE

(71) Applicant: TAIYUAN UNIVERSITY OF TECHNOLOGY, Shanxi (CN)

(72) Inventors: Tao Wang, Shanxi (CN); Jinzhu Zhang, Shanxi (CN); Dongping He, Shanxi (CN); Zepeng Lu, Shanxi (CN); Yaguan Li, Shanxi (CN); Fanglin Li, Shanxi (CN); Ting Li, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 191 days.

(21) Appl. No.: 17/515,555

(22) Filed: Nov. 1, 2021

(65) Prior Publication Data

US 2022/0048159 A1 Feb. 17, 2022

Related U.S. Application Data

(63) Continuation of application No. PCT/CN2021/085156, filed on Apr. 2, 2021.

(51) Int. Cl.
*B24B 47/10* (2006.01)
*B24B 27/033* (2006.01)

(52) U.S. Cl.
CPC ..... *B24B 47/10* (2013.01); *B24B 27/033* (2013.01)

(58) Field of Classification Search
CPC ..... B24B 41/02; B24B 41/04; B24B 27/033; B24B 49/12; B24B 47/00; B24B 47/10
See application file for complete search history.

(56) References Cited

FOREIGN PATENT DOCUMENTS

CN 209093972 U * 7/2019

* cited by examiner

*Primary Examiner* — Moshe Wilensky

(57) ABSTRACT

A rigid-flexible coupling-driven robot for removing oxide scales on super large shaft forgings online includes a heavy-duty manipulator main body, four walking systems, a movable arm lifting system, a clamping system, a power system, two oxide scale removal systems and a visual identification system. The two oxide scale removal systems are respectively installed on the two trapezoidal plates of the clamping system. Each of the two oxide scale removal systems adopts rigid-flexible coupling drive technology, that is, the rigid drive of the overhead hydraulic cylinder, cable-stayed hydraulic cylinder, the long stroke scissor retractable bracket and the rack and pinion device is combined with the flexible drive of the wire rope, so that the retraction and the angle tilt of the parallelogram end removal device are realized, which makes the oxide scale removal more flexible and efficient, thus greatly improving the product quality of large forgings.

3 Claims, 6 Drawing Sheets

RIGID-FLEXIBLE COUPLING-DRIVEN ROBOT FOR REMOVING OXIDE SCALES ON SUPER LARGE SHAFT FORGINGS ONLINE

CROSS REFERENCE OF RELATED APPLICATION

This is a Continuation Application of the International Application PCT/CN2021/085156, filed on Apr. 2, 2021, which claims the benefit of CN 202010681678.6 and priority date of Jul. 15, 2020.

BACKGROUND OF THE PRESENT INVENTION

Field of Invention

The present invention relates to the field of the device for removing oxide scales of forging blanks, and more particularly to a rigid-flexible coupling-driven robot for removing oxide scales on super large shaft forgings online.

Description of Related Arts

At present, the transformation of the equipment manufacturing industry is imminent in China, and intelligent production is the only way to transform and upgrade the equipment manufacturing industry. The forging industry is a part of the traditional labor-intensive industry, and the forging industry robot is able to replace manual work to complete all the production processes of the entire production line, including automatic feeding, automatic forming, oxide scale removal, and automatic trimming, so that the influence of human factors is reduced. At the same time, the forging industrial robot is able to realize automatic fault warnings and alarms, ensuring safe production and prevent equipment damage and casualties to a greater extent, so that the entire forging automated production line is able to achieve true intelligent manufacturing.

Super large shaft forgings are mainly used in the core parts of high-end equipment. They are the basic parts for manufacturing major equipment. They reflect the country's extreme manufacturing capacity and manufacturing level, and are an important guarantee for the national economy. The super large shaft forgings are very widely used and mainly used in the construction of national key projects, national defense projects and major infrastructures, such as aerospace, marine equipment, ships, nuclear power, thermal power, wind power, rail transit, petrochemical, metallurgy, and new energy.

In the forging process of super large shaft parts, oxide scales will be generated when metals and substances such as oxygen and water vapor in the air oxidize at high temperature. Oxide scales will make the surface of forgings rough and affect the appearance quality of forgings. They have high hardness, which not only increases the deformation energy consumption during forging, but also accelerates the wear of forgings and dies and reduces the service life. During the forging process, if the oxide scales are unable to be promptly and quickly removed and pressed into the forgings, the quality of the products will be affected, or even scrapped in severe cases. For example, the large shaft forgings in wind power equipment weigh tens of tons, and once they are scrapped, the loss will be huge. Therefore, a method for quickly and efficiently removing oxide scales online should be adopted. At present, the methods for removing oxide scales are pickling passivation, electropolishing, laser removal, manual or high-pressure water. The use of chemical methods such as pickling will pollute the environment; the use of high-pressure water will reduce the initial temperature of forgings, affecting the quality of the finished product; the manual removal of oxide scales is inefficient and works in harsh environment. Therefore, it is very important to research a rigid-flexible coupling-driven robot for removing oxide scales on super large shaft forgings online, which is of great significance to the transformation and upgrading of the traditional forging industry.

SUMMARY OF THE PRESENT INVENTION

Aiming at the above problems, the present invention provides a rigid-flexible coupling-driven robot for removing oxide scales on super large shaft forgings online.

To achieve the above object, the present invention adopts technical solutions as follows.

A rigid-flexible coupling-driven robot for removing oxide scales on super large shaft forgings online comprises a heavy-duty manipulator main body, four walking systems, a movable arm lifting system, a clamping system, a power system, two oxide scale removal systems and a visual identification system, wherein:

- the heavy-duty manipulator main body comprises a front beam, a front lifting arm beam, a rear lifting arm beam, two side plates, a balancing weight and two guide rails, wherein:
  - the two guide rails are installed on foundation in parallel, the two side plates respectively contact with the two guide rails through the four walking systems which are installed below the two side plates, the front beam and the balancing weight are fixed between the two side plates, the front beam is located at a front of the two side plates, the balancing weight is located at a rear of the two side plates, both the front lifting arm beam and the rear lifting arm beam are rotatably installed between the two side plates;
- each of the four walking systems comprises a walking five-star hydraulic motor, a walking motor coupling, and a walking steel wheel, four walking five-star hydraulic motors are respectively located at two front ends and two rear ends of two lower surfaces of the two side plates, wherein:
  - the walking steel wheel is rotatably connected with the walking five-star hydraulic motor through the walking motor coupling;
- the movable arm lifting system comprises two front lifting hydraulic cylinders, two rear lifting hydraulic cylinders and four lifting arms, wherein:
  - two upper ends of the two front lifting hydraulic cylinders are respectively hinged at a left end and a right end of the front lifting arm beam, two lower ends of the two front lifting hydraulic cylinders are respectively hinged at two lower portions of the two side plates, two upper ends of the two rear lifting hydraulic cylinders are respectively hinged at a left end and a right end of the rear lifting arm beam, two lower ends of the two rear lifting hydraulic cylinders are respectively hinged at the two lower portions of the two side plates, four upper ends of the four lifting arms are respectively hinged at a left end portion and a right end portion of the front lifting arm beam and a left end portion and a right end portion of the rear lifting arm beam, four lower ends of the four lifting arms are hinged with a clamp holder;

the clamping system comprises the clamp holder, a hollow shaft, a clamp rotary table, a clamp rotary device and a clamp retractable device, wherein:

the clamp holder is fixed between the two side plates, the hollow shaft is rotatably inserted into the clamp holder, the clamp rotary table is installed at a front end of the hollow shaft; the clamp rotary device comprises a gear plate, two meshing gears and two clamp rotary five-star hydraulic motors, wherein:

the two clamp rotary five-star hydraulic motors are respectively located at two sides of the hollow shaft and are fixed with the clamp holder, the two meshing gears are respectively fixed with two output shafts of the two clamp rotary five-star hydraulic motors, the gear plate is sleeved and fixed with the hollow shaft and engaged with the two meshing gears;

the clamp retractable device comprises two clamp retractable units symmetrically arranged to each other, wherein each of the two clamp retractable units comprises a clamp retractable hydraulic cylinder, a clamp end connection rod, a clamp intermediate connection rod, a clamp head portion and an installation plate, wherein:

the clamp retractable hydraulic cylinder is installed at a rear end of the clamp holder, two ends of the clamp intermediate connection rod are respectively connected with the clamp end connection rod and the clamp head portion through two clamp rotary shafts, a middle portion of a rear end of the clamp head portion is hinged with a front end of the installation plate through a clamp rotary shaft, a rear end of the installation plate is fixed with the clamp rotary table, two trapezoidal plates symmetrically arranged to each other are fixed with a front end of the clamp holder through fastening screws, two projecting shafts respectively symmetrically extend from two sides of the clamp holder, two guide support wheels are respectively rotatably connected with the two projecting shafts;

the power system comprises a hydraulic station and a distribution box both of which are fixed on the balancing weight for providing hydraulic components and electrical components of the robot with power, respectively;

the two oxide scale removal systems are respectively installed on the two trapezoidal plates, wherein each of the two oxide scale removal systems comprises a base, two overhead hydraulic cylinders, a cable-stayed hydraulic cylinder, two sliders, a long stroke scissor retractable bracket, an L-shaped block, a rack and pinion device, a retractable shaft, a parallelogram end removal device and a flexible rope transmission device, wherein:

the base, the two overhead hydraulic cylinders, the two sliders and the long stroke scissor retractable bracket form a first rigid-flexible coupling retractable device, the base is fixed on one of the two trapezoidal plates, two ends of one of the two overhead hydraulic cylinders are respectively hinged with the base and one of the two sliders through a first pin shaft and a second pin shaft, one end of the cable-stayed hydraulic cylinder is hinged with the base through a third pin shaft, another end of the cable-stayed hydraulic cylinder is hinged with a middle portion of the long stroke scissor retractable bracket through a fourth pin shaft, the one of the two sliders is rotatably connected with a lower end of the long stroke scissor retractable bracket through the first pin shaft;

the long stroke scissor retractable bracket comprises multiple parallelogram units rotatably connected with each other through multiple rotary shafts, respectively, the L-shaped block is fixed to a rear end of the long stroke scissor retractable bracket, a front end of a rack of the rack and pinion device is fixed with the L-shaped block, a rear end of the rack of the rack and pinion device penetrates through the base and the one of the two trapezoidal plates and is movably placed on one of the two guide support wheels, a pinion of the rack and pinion device is fixed to an output shaft of a rack drive motor, the rack drive motor is installed on the clamp holder, the retractable shaft is a sleeve retractable shaft, two ends of the retractable shaft are respectively fixed with the base and the L-shaped block for allowing cables to pass through;

the parallelogram end removal device comprises two parallelogram rods, a wire brush, a front plate, and an installation bracket, wherein the two parallelogram rods are rotatably connected with the L-shaped block through a first rotation shaft, the two parallelogram rods are able to act together through the first rotation shaft, a second rotation shaft, a third rotation shaft and a fourth rotation shaft, the front plate is installed between the two parallelogram rods, the installation bracket is fixed with the front plate through screws, the removal motor is fixed within the installation bracket, the wire brush is rotatably connected with the removal motor, the wire brush is installed at a left side of the front plate;

the flexible rope transmission device comprises two wire ropes and at least two lock devices, two fifth pin shafts are respectively located at a left side and a right side of the two parallelogram rods, a trough is provided in a middle of each of the two fifth pin shafts, one end of one of the two wire ropes passes through the trough and is rotatably connected with one of the at least two lock devices, another end of the one of the two wire ropes passes through the base and the one of the two trapezoidal plates, and winds around an output shaft of a first winding motor, another end of another of the two wire ropes passes through the base and the one of the two trapezoidal plates, and winds around an output shaft of a second winding motor;

the visual identification system comprises a slider-crank device, two high temperature resistant industrial cameras and a second rigid-flexible coupling retractable device having a same structure with the first rigid-flexible coupling retractable device, wherein:

the second rigid-flexible coupling retractable device is fixed on the front beam;

the slider-crank device comprises a first flexible rope, a second flexible rope, a first connection lever, a second connection lever, a flexible sheave, a visual bracket, a guiding stick, a transverse bar and a two-way guide wheel, wherein the visual bracket is to fixed at a front end of a long stroke scissor retractable bracket of the second rigid-flexible coupling retractable device, one end of the first flexible rope and one end of the second flexible rope are fixed at a front end of the flexible sheave, another end of the first flexible rope and another end of the second flexible rope respectively go around an upper wheel and a lower wheel of the two-way guide wheel and wind around an output shaft of a third winding motor and an output shaft of a fourth winding motor; one end of the first connection lever is fixed with the flexible sheave, another end of the first connection lever is rotatably connected with one end of the second connection lever, another end of the second connection lever is rotatably connected with the guiding stick, the guiding stick is installed on the visual bracket, the transverse bar is fixed at an end portion of the visual bracket, and the two high temperature resistant industrial cameras are respectively installed at two ends of the transverse bar.

Preferably, an axis of the wire brush, an axis of the hollow shaft and an axis of a forging are always in a same horizontal plane.

Preferably, a guide pulley is rotatably located at a hinge shaft in a middle portion of an inner side of the long stroke scissor retractable bracket of the first rigid-flexible coupling retractable device, so as to guide the two wire ropes close to the long stroke scissor retractable bracket.

Compared with prior arts, the present invention has some advantages as follows.

(1) According to the present invention, two oxide scale removal systems are respectively installed on two trapezoidal plates for realizing the up and down synchronous movement of forgings and the oxide scale removal systems, thereby ensuring that the operation center of each oxide scale removal system is always consistent with the center of the super large shaft forging.

(2) The oxide scale removal system provided by the present invention adopts rigid-flexible coupling drive technology, that is, the rigid drive of the overhead hydraulic cylinder, cable-stayed hydraulic cylinder, the long stroke scissor retractable bracket and the rack and pinion device is combined with the flexible drive of the wire rope, so that the retraction and the angle tilt of the parallelogram end removal device are realized, which makes the oxide scale removal more flexible and efficient, thus greatly improving the product quality of large forgings.

(3) The present invention adopts a fully automatic and controllable online process, and replace manual operation with the robot for removing oxide scales, which effectively improves the working environment of the staff, improves work efficiency, reduces work risks, improves the product quality of large forgings, and saves labor costs.

Figure 1:
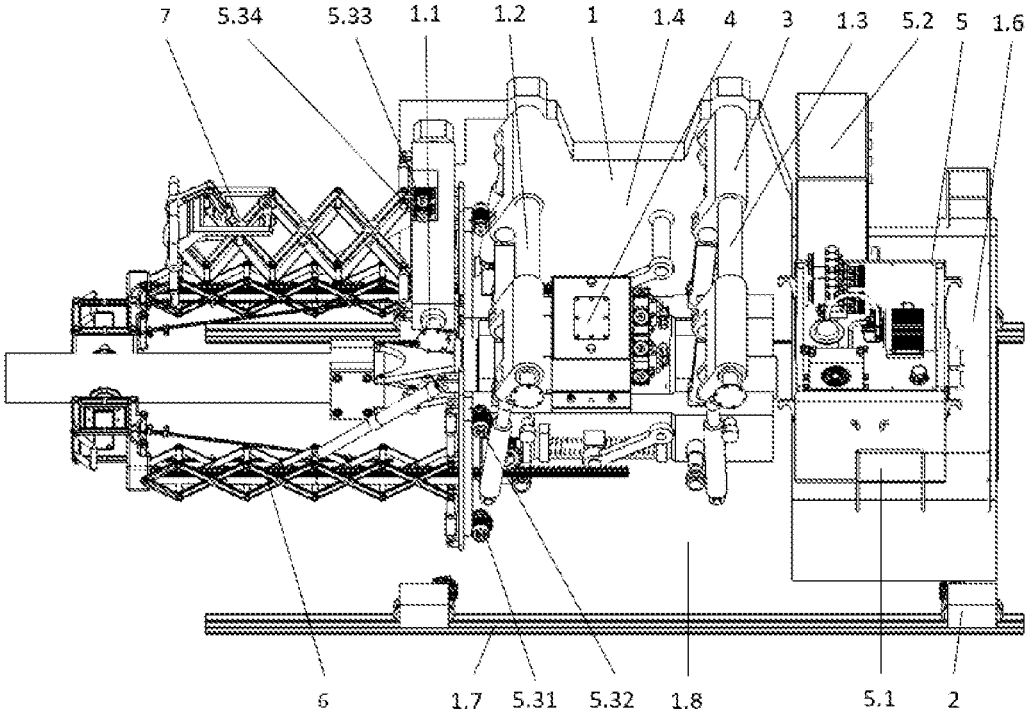
FIG. 1 is a structurally schematic view of a rigid-flexible coupling-driven robot for removing oxide scales on super large shaft forgings online provided by the present invention.

In the drawings, 1: heavy-duty manipulator main body; 2: walking system; 3: movable arm lifting system; 4: clamping system; 5: power system; 6: oxide scale removal system; 7: visual identification system; 1.1: front beam; 1.2: front lifting arm beam; 1.3: rear lifting arm beam; 1.4: side plate; 1.6: balancing weight; 1.7: guide rail; 2.1: five-star hydraulic motor; 2.2: walking motor coupling; 2.3: walking steel wheel; 3.1: rear lifting hydraulic cylinder; 3.2: front lifting hydraulic cylinder; 3.3: lifting arm; 4.1: clamp holder; 4.2: hollow shaft; 4.3: clamp rotary table; 4.7: clamp rotary device; 4.8: clamp retractable device; 4.11: clamp retractable hydraulic cylinder; 4.12: clamp end connection rod; 4.13: clamp intermediate connection rod; 4.14: clamp head portion; 4.15: clamp rotary shaft; 4.16: gear plate; 4.17: meshing gear; 4.18: clamp rotary five-star hydraulic motor; 4.21: installation plate; 5.31: first winding motor; 5.32: second winding motor; 5.33: third winding motor; 5.34: fourth winding motor; 5.35: rack drive motor; 6.1: base; 6.2: overhead hydraulic cylinder; 6.3: cable-stayed hydraulic cylinder; 6.4: slider; 6.5: long stroke scissor retractable bracket; 6.6: L-shaped block; 6.7: rack and pinion device; 6.8: retractable shaft; 6.9: parallelogram end removal device; 6.0: flexible rope transmission device; 6.11: first pin shaft; 6.12: second pin shaft; 6.13: third pin shaft; 6.14: fourth pin shaft; 6.16: rotary shaft; 6.91: wire brush; 6.92: front plate; 6.93 installation bracket; 6.94: first rotation shaft; 6.95: second rotation shaft; 6.96: third rotation shaft; 6.97: fourth rotation shaft; 6.98: parallelogram rod; 6.01: wire rope; 6.02: lock device; 6.04: trough; 7.1: slider-crank device; 7.2: high temperature resistant industrial camera; 7.11 first flexible rope; 7.12: second flexible rope; 7.13: first connection lever; 7.14: second connection lever; 7.15: flexible sheave; 7.16: visual bracket; 7.17: guiding stick; 7.18: transverse bar; 7.19: two-way guide wheel.

DETAILED DESCRIPTION OF THE PREFERRED EMBODIMENT

To further describe technical solutions of the present invention, the present invention is explained in combination with embodiments as follows.

Figure 2:
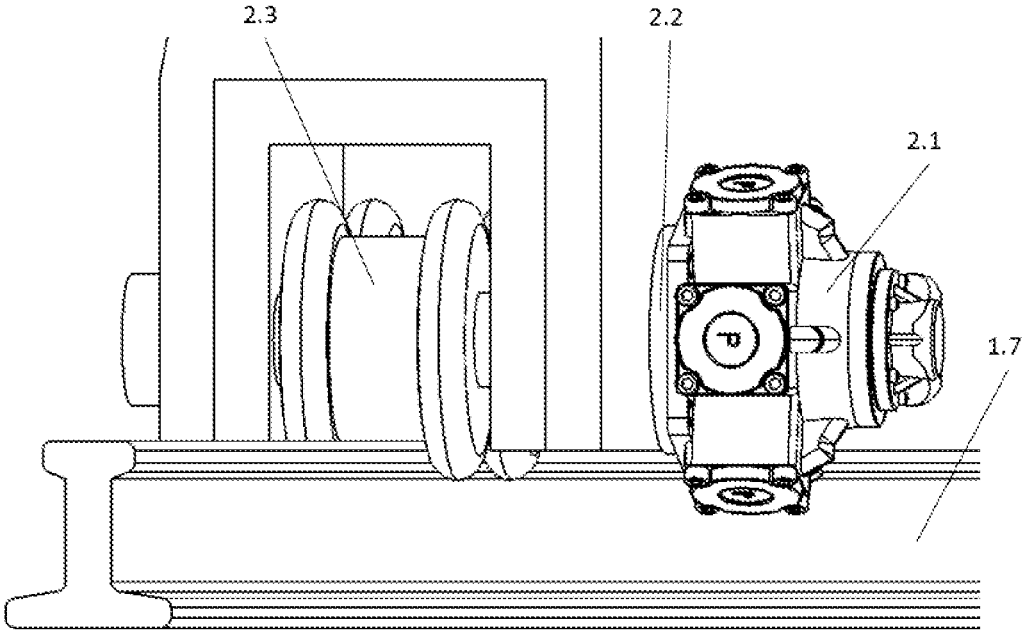
FIG. 2 is a structurally schematic view of a walking system of the robot provided by the present invention.
Figure 3:
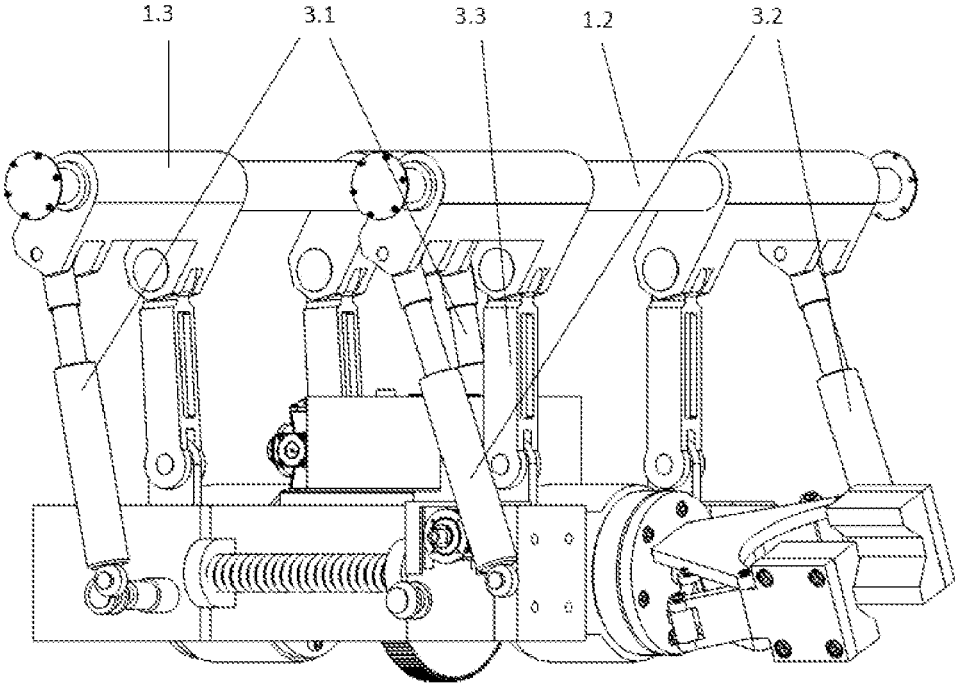
FIG. 3 is a structurally schematic view of a movable arm lifting system of the robot provided by the present invention.
Figure 4:
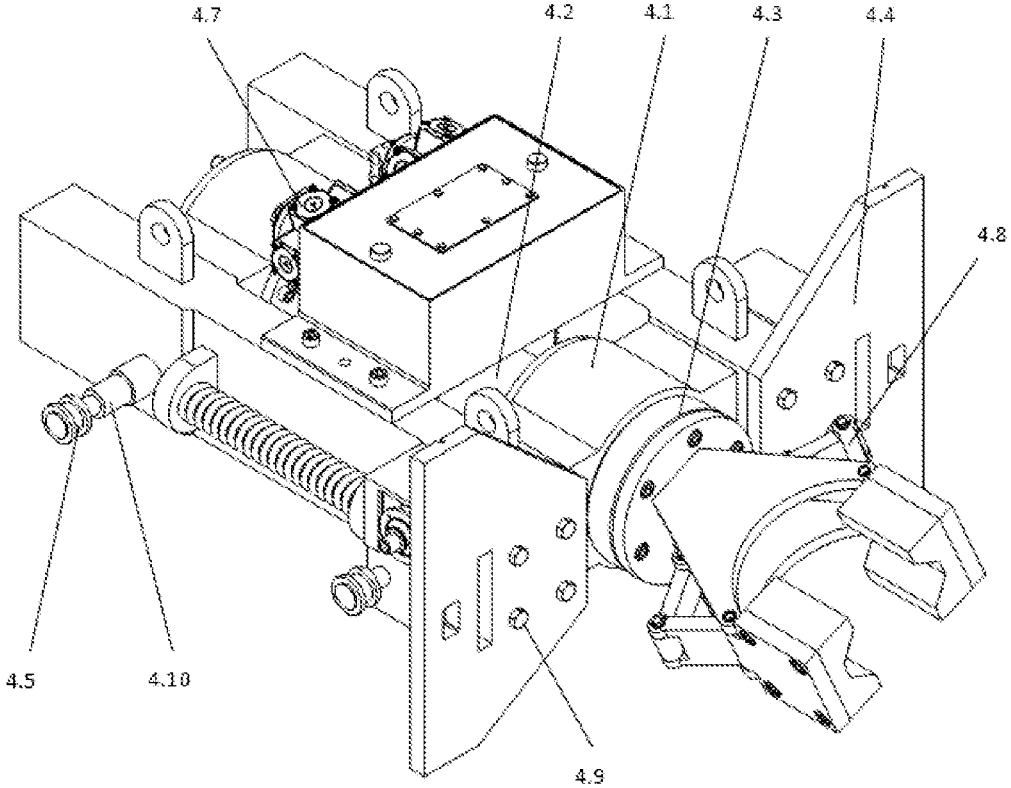
FIG. 4 is a structurally schematic view of a clamping system of the robot provided by the present invention.
Figure 5:
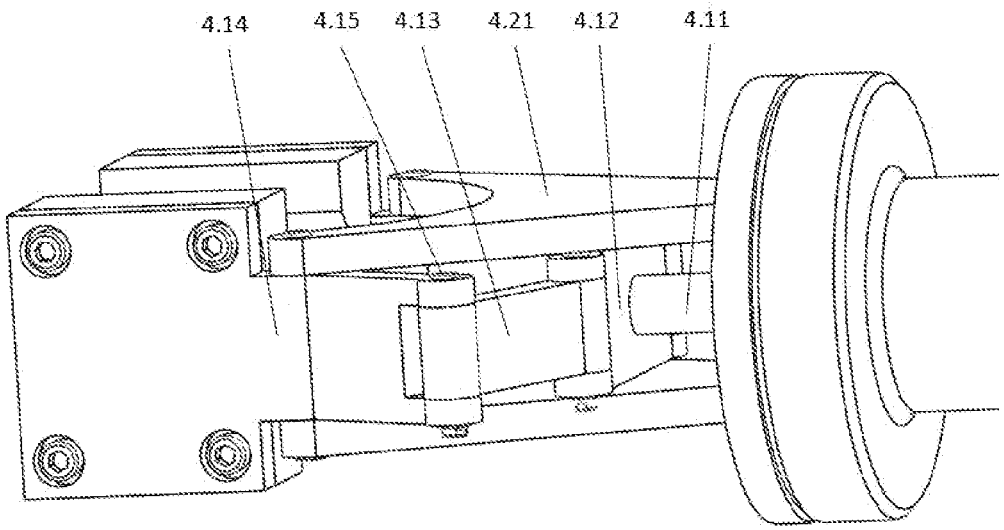
FIG. 5 is a structurally schematic view of a clamp retractable device of the clamping system.
Figure 6:
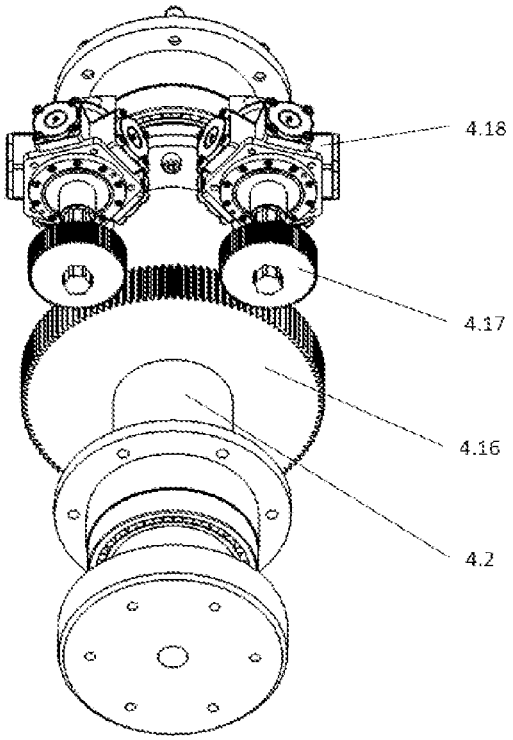
FIG. 6 is a structurally schematic view of a clamp rotary device of the clamping system.
Figure 7:
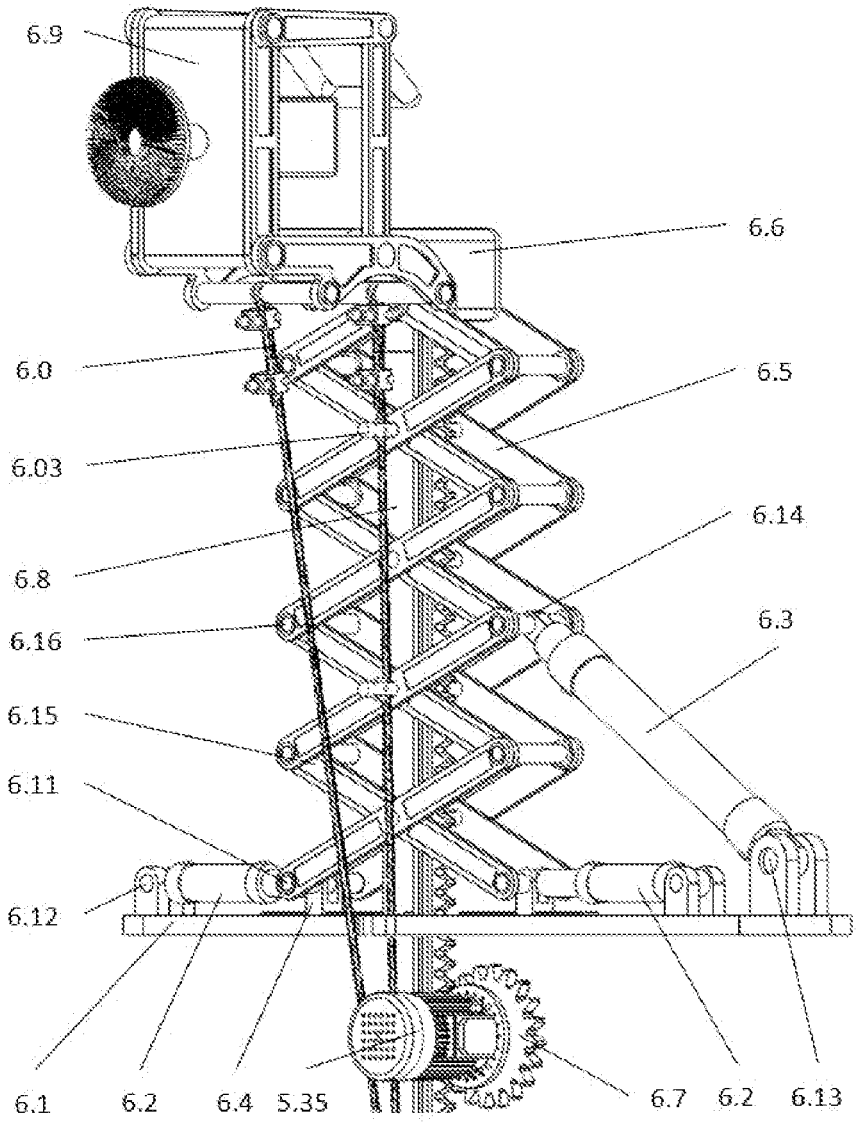
FIG. 7 is a structurally schematic view of an oxide scale removal system of the robot provided by the present invention.
Figure 8:
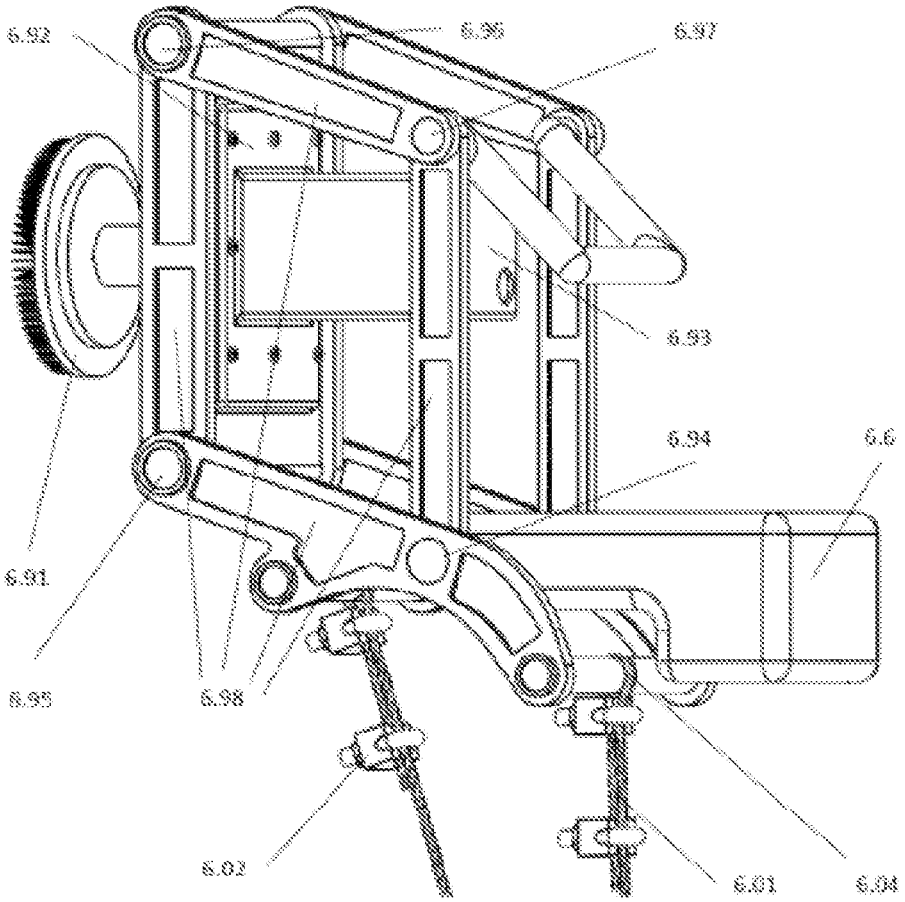
FIG. 8 is a structurally schematic view of a parallelogram end removal device of the oxide scale removal system of the robot provided by the present invention.
Figure 9:
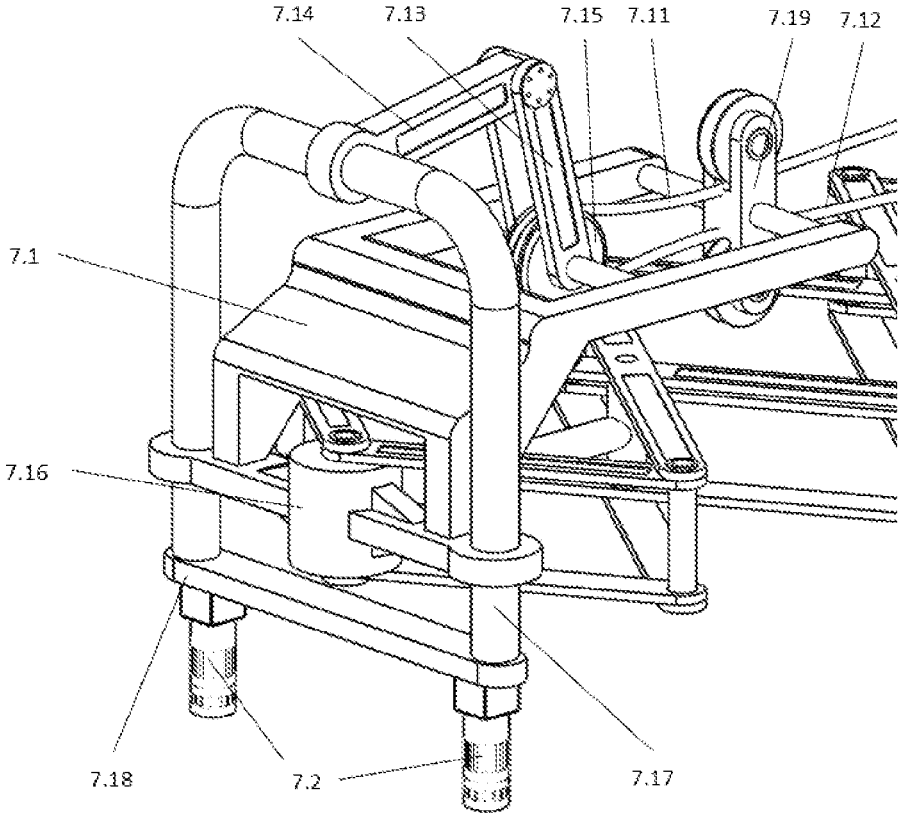
FIG. 9 is a slider-crank device of a visual identification system of the robot provided by the present invention.

Referring to FIGS. 1 to 9, a rigid-flexible coupling-driven robot for removing oxide scales on super large shaft forgings online according to a preferred embodiment of the present invention is illustrated. The rigid-flexible coupling-driven robot comprises a heavy-duty manipulator main body 1, four walking systems 2, a movable arm lifting system 3, a clamping system 4, a power system 5, two oxide scale removal systems 6 and a visual identification system 7, wherein:

the heavy-duty manipulator main body 1 comprises a front beam 1.1, a front lifting arm beam 1.2, a rear lifting arm beam 1.3, two side plates 1.4, a balancing weight 1.6 and two guide rails 1.7, wherein the two guide rails 1.7 are installed on foundation 1.8 in parallel, the two side plates 1.4 respectively contact with the two guide rails 1.7 through the four walking systems 2 which are installed below the two side plates 1.4, the front beam 1.1 and the balancing weight 1.6 are fixed between the two side plates 1.4, the front beam 1.1 is located at a front of the two side plates 1.4, the balancing weight 1.6 is located at a rear of the two side plates 1.4, both the front lifting arm beam 1.2 and the rear lifting arm beam 1.3 are rotatably installed between the two side plates 1.4;

each of the four walking systems 2 comprises a walking five-star hydraulic motor 2.1, a walking motor coupling 2.2, and a walking steel wheel 2.3; four walking five-star hydraulic motors 2.1 are respectively located at two front ends and two rear ends of two lower surfaces of the two side plates 1.4, wherein the walking steel wheel 2.3 is rotatably connected with the walking five-star hydraulic motor 2.1 through the walking motor coupling 2.2;

the movable arm lifting system 3 comprises two front lifting hydraulic cylinders 3.2, two rear lifting hydraulic cylinders 3.1 and four lifting arms 3.3, wherein two upper ends of the two front lifting hydraulic cylinders 3.2 are respectively hinged at a left end and a right end of the front lifting arm beam 1.2, two lower ends of the two front lifting hydraulic cylinders 3.2 are respectively hinged at two lower portions of the two side plates 1.4, two upper ends of the two rear lifting hydraulic cylinders 3.1 are respectively hinged at a left end and a right end of the rear lifting arm beam 1.3, two lower ends of the two rear lifting hydraulic cylinders 3.1 are respectively hinged at the two lower portions of the two side plates 1.4, four upper ends of the four lifting arms 3.3 are respectively hinged at a left end portion and a right end portion of the front lifting arm beam 1.2 and a left end portion and a right end portion of the rear lifting arm beam 1.3, four lower ends of the four lifting arms 3.3 are hinged with a clamp holder 4.1;

the clamping system 4 comprises the clamp holder 4.1, a hollow shaft 4.2, a clamp rotary table 4.3, a clamp rotary device 4.7 and a clamp retractable device 4.8, wherein the clamp holder 4.1 is fixed between the two side plates 1.4, the hollow shaft 4.2 is rotatably inserted into the clamp holder 4.1, the clamp rotary table 4.3 is installed at a front end of the hollow shaft 4.2; the clamp rotary device 4.7 comprises a gear plate 4.16, two meshing gears 4.17 and two clamp rotary five-star hydraulic motors 4.18, wherein the two clamp rotary five-star hydraulic motors 4.18 are respectively located at two sides of the hollow shaft 4.2 and are fixed with the clamp holder 4.1, the two meshing gears 4.17 are respectively fixed with two output shafts of the two clamp rotary five-star hydraulic motors 4.18, the gear plate 4.16 is sleeved and fixed with the hollow shaft 4.2 and engaged with the two meshing gears 4.17; the clamp retractable device 4.8 comprises two clamp retractable units symmetrically arranged to each other, wherein each of the two clamp retractable units comprises a clamp retractable hydraulic cylinder 4.11, a clamp end connection rod 4.12, a clamp intermediate connection rod 4.13, a clamp head portion 4.14 and an installation plate 4.21, wherein the clamp retractable hydraulic cylinder 4.11 is installed at a rear end of the clamp holder 4.1, two ends of the clamp intermediate connection rod 4.13 are respectively connected with the clamp end connection rod 4.12 and the clamp head portion 4.14 through two clamp rotary shafts 4.15, a middle portion of a rear end of the clamp head portion 4.14 is hinged with a front end of the installation plate 4.21 through a clamp rotary shaft 4.15, a rear end of the installation plate 4.21 is fixed with the clamp rotary table 4.3, two trapezoidal plates 4.4 symmetrically arranged to each other are fixed with a front end of the clamp holder 4.1 through fastening screws 4.9, two projecting shafts 4.10 respectively symmetrically extend from two sides of the clamp holder 4.1, two guide support wheels 4.5 are respectively rotatably connected with the two projecting shafts 4.10;

the power system 5 comprises a hydraulic station 5.1 and a distribution box 5.2 both of which are fixed on the balancing weight 1.6 for providing hydraulic components and electrical components of the robot with power, respectively;

the two oxide scale removal systems 6 are respectively installed on the two trapezoidal plates 4.4, wherein each of the two oxide scale removal systems 6 comprises a base 6.1, two overhead hydraulic cylinders 6.2, a cable-stayed hydraulic cylinder 6.3, two sliders 6.4, a long stroke scissor retractable bracket 6.5, an L-shaped block 6.6, a rack and pinion device 6.7, a retractable shaft 6.8, a parallelogram end removal device 6.9 and a flexible rope transmission device 6.0, wherein the base 6.1, the two overhead hydraulic cylinders 6.2, the two sliders 6.4 and the long stroke scissor retractable bracket 6.5 form a first rigid-flexible coupling retractable device, the base 6.1 is fixed on one of the two trapezoidal plates 4.4, two ends of one of the two overhead hydraulic cylinders 6.2 are respectively hinged with the base 6.1 and one of the two sliders 6.4 through a first pin shaft 6.11 and a second pin shaft 6.12, one end of the cable-stayed hydraulic cylinder 6.3 is hinged with the base 6.1 through a third pin shaft 6.13, another end of the cable-stayed hydraulic cylinder 6.3 is hinged with a middle portion of the long stroke scissor retractable bracket 6.5 through a fourth pin shaft 6.14, the one of the two sliders 6.4 is rotatably connected with a lower end of the long stroke scissor retractable bracket 6.5 through the first pin shaft 6.11, the long stroke scissor retractable bracket 6.5 comprises multiple parallelogram units rotatably connected with each other through multiple rotary shafts 6.16, respectively, the L-shaped block 6.6 is fixed to an upper end of the long stroke scissor retractable bracket 6.5, a front end of a rack of the rack and pinion device 6.7 is fixed with the L-shaped block 6.6, a rear end of the rack of the rack and pinion device 6.7 penetrates through the base 6.1 and the one of the two trapezoidal plates 4.4 and is movably placed on one of the two guide support wheels 4.5, a pinion of the rack and pinion device 6.7 is fixed to an output shaft of a rack drive motor 5.35, the rack drive motor 5.35 is installed on the clamp holder 4.1, the retractable shaft 6.8 is a sleeve retractable shaft, two ends of the retractable shaft 6.8 are respectively fixed with the base 6.1 and the L-shaped block 6.6 for allowing cables to pass through, the parallelogram end removal device 6.9 comprises two parallelogram rods 6.98, a wire brush 6.91, a front plate 6.92, and an installation bracket 6.93, wherein the two parallelogram rods 6.98 are rotatably connected with the L-shaped block 6.6 through a first rotation shaft 6.94, the two parallelogram rods 6.98 are able to act together through the first rotation shaft 6.94, a second rotation shaft 6.95, a third rotation shaft 6.96 and a fourth rotation shaft 6.97, the front plate 6.92 is located between the two parallelogram rods 6.98, the installation bracket 6.93 is fixed with the front plate 6.92 through screws, the removal motor is fixed within the installation bracket 6.93, the wire brush 6.91 is rotatably connected with the removal motor, the wire brush 6.91 is installed at a left side of the front plate 6.92; an axis of the wire brush 6.91, an axis of the hollow shaft 4.2 and an axis of a forging are always in a same horizontal plane; the flexible rope transmission device 6.0 comprises two wire ropes 6.01 and at least two lock devices 6.02, two fifth pin shafts are respectively located at a left side and a right side of the two parallelogram rods 6.98, a trough 6.04 is provided in a middle of each of the two fifth pin shafts, one end of one of the two wire ropes 6.01 passes through the trough 6.04 and is rotatably connected with one of the at least two lock devices 6.02, another end of the one of the two wire ropes 6.01 passes through the base 6.1 and the one of the two trapezoidal plates 4.4, and winds around an output shaft of a first winding motor 5.31, another end of another of the two wire ropes 6.01 passes through the base 6.1 and the one of the two trapezoidal plates 4.4, and winds around an output shaft of a second winding motor 5.32, a guide pulley 6.03 is rotatably located at a hinge shaft in a middle portion of an inner side of the long stroke scissor retractable bracket 6.5 of the first rigid-flexible coupling retractable device, so as to guide one wire rope 6.01 close to the long stroke scissor retractable bracket 6.5;

the visual identification system 7 comprises a slider-crank device 7.1, two high temperature resistant industrial cameras 7.2 and a second rigid-flexible coupling retractable device having a same structure with the first rigid-flexible coupling retractable device, wherein the second rigid-flexible coupling retractable device is fixed on the front beam 1.1; the slider-crank device 7.1 comprises a first flexible rope 7.11, a second flexible rope 7.12, a first connection lever 7.13, a second connection lever 7.14, a flexible sheave 7.15, a visual bracket 7.16, a guiding stick 7.17, a transverse bar 7.18 and a two-way guide wheel 7.19, wherein the visual bracket 7.16 is fixed at a front end of a long stroke scissor retractable bracket of the second rigid-flexible coupling retractable device, one end of the first flexible rope 7.11 and one end of the second flexible rope 7.12 are fixed at a front end of the flexible sheave 7.15, another end of the first flexible rope 7.11 and another end of the second flexible rope 7.12 respectively go around an upper wheel and a lower wheel of the two-way guide wheel 7.19 and wind around an output shaft of a third winding motor 5.33 and an output shaft of a fourth winding motor 5.34; one end of the first connection lever 7.13 is fixed with the flexible sheave 7.15, another end of the first connection lever 7.13 is rotatably connected with one end of the second connection lever 7.14, another end of the second connection lever 7.14 is rotatably connected with the guiding stick 7.17, the guiding stick 7.17 is installed on the visual bracket 7.16, the transverse bar 7.18 is fixed at an end portion of the visual bracket 7.16, and the two high temperature resistant industrial cameras 7.2 are respectively installed at two ends of the transverse bar 7.18.

The main features and advantages of the present invention are shown and described above. For those skilled in the art, it is obvious that the present invention is not limited to the details of the above exemplary embodiments, and is able to be achieved without departing from the spirit or basic characteristics of the present invention. Therefore, regardless of the point of view, the embodiments should be regarded as exemplary and non-limiting. The scope of the present invention is defined by the appended claims rather than the above description, and therefore it is intended that all changes falling within the meaning and scope of equivalent elements of the claims are included in the present invention.

In addition, it should be understood that although the present specification is described in accordance with embodiments, not each embodiment only includes an independent technical solution, and the description of the present invention is only for clarity. Those skilled in the art should regard the specification as a whole. The technical solutions in the various embodiments are also able to be appropriately combined to form other embodiments that are able be understood by those skilled in the art.

The present invention can be implemented in other specific forms. Therefore, from any point of view, the embodiments should be regarded as exemplary and non-restrictive. The scope of the present invention is defined by the appended claims rather than the above description, and therefore it is intended to fall within the claims. All changes within the meaning and scope of the equivalent elements of are included in the present invention.

What is claimed is:

1. A rigid-flexible coupling-driven robot for removing oxide scales on super large shaft forgings online, the rigid-flexible coupling-driven robot comprising a heavy-duty manipulator main body, four walking systems, a movable arm lifting system, a clamping system, a power system, two oxide scale removal systems and a visual identification system, wherein:

the heavy-duty manipulator main body comprises a front beam, a front lifting arm beam, a rear lifting arm beam, two side plates, a balancing weight and two guide rails, wherein:

the two guide rails are installed on foundation in parallel, the two side plates respectively contact with the two guide rails through the four walking systems which are installed below the two side plates, the front beam and the balancing weight are fixed between the two side plates, the front beam is located at a front of the two side plates, the balancing weight is located at a rear of the two side plates, both the front lifting arm beam and the rear lifting arm beam are rotatably installed between the two side plates;

each of the four walking systems comprises a walking five-star hydraulic motor, a walking motor coupling, and a walking steel wheel; four walking five-star hydraulic motors are respectively located at two front ends and two rear ends of two lower surfaces of the two side plates, wherein:

the walking steel wheel is rotatably connected with the walking five-star hydraulic motor through the walking motor coupling;

the movable arm lifting system comprises two front lifting hydraulic cylinders, two rear lifting hydraulic cylinders and four lifting arms, wherein:

two upper ends of the two front lifting hydraulic cylinders are respectively hinged at a left end and a right end of the front lifting arm beam, two lower ends of the two front lifting hydraulic cylinders are respectively hinged at two lower portions of the two side plates, two upper ends of the two rear lifting hydraulic cylinders are respectively hinged at a left end and a right end of the rear lifting arm beam, two lower ends of the two rear lifting hydraulic cylinders are respectively hinged at the two lower portions of the two side plates, four upper ends of the four lifting arms are respectively hinged at a left end portion and a right end portion of the front lifting arm beam and a left end portion and a right end portion of the rear lifting arm beam, four lower ends of the four lifting arms are hinged with a clamp holder;

the clamping system comprises the clamp holder, a hollow shaft, a clamp rotary table, a clamp rotary device and a clamp retractable device, wherein:

the clamp holder is fixed between the two side plates, the hollow shaft is rotatably inserted into the clamp holder, the clamp rotary table is installed at a front end of the hollow shaft; the clamp rotary device comprises a gear plate, two meshing gears and two clamp rotary five-star hydraulic motors, wherein:

the two clamp rotary five-star hydraulic motors are respectively located at two sides of the hollow shaft and are fixed with the clamp holder, the two meshing gears are respectively fixed with two output shafts of the two clamp rotary five-star hydraulic motors, the gear plate is sleeved and fixed with the hollow shaft and engaged with the two meshing gears;

the clamp retractable device comprises two clamp retractable units symmetrically arranged to each other, wherein each of the two clamp retractable units comprises a clamp retractable hydraulic cylinder, a clamp end connection rod, a clamp intermediate connection rod, a clamp head portion and an installation plate, wherein:

the clamp retractable hydraulic cylinder is installed at a rear end of the clamp holder, two ends of the clamp intermediate connection rod are respectively connected with the clamp end connection rod and the clamp head portion through two clamp rotary shafts, a middle portion of a rear end of the clamp head portion is hinged with a front end of the installation plate through a clamp rotary shaft, a rear end of the installation plate is fixed with the clamp rotary table, two trapezoidal plates symmetrically arranged to each other are fixed with a front end of the clamp holder through fastening screws, two projecting shafts respectively symmetrically extend from two sides of the clamp holder, two guide support wheels are respectively rotatably connected with the two projecting shafts;

the power system comprises a hydraulic station and a distribution box both of which are fixed on the balancing weight for providing hydraulic components and electrical components of the robot with power, respectively;

the two oxide scale removal systems are respectively installed on the two trapezoidal plates, wherein each of the two oxide scale removal systems comprises a base, two overhead hydraulic cylinders, a cable-stayed hydraulic cylinder, two sliders, a long stroke scissor retractable bracket, an L-shaped block, a rack and pinion device, a retractable shaft, a parallelogram end removal device and a flexible rope transmission device, wherein:

the base, the two overhead hydraulic cylinders, the two sliders and the long stroke scissor retractable bracket form a first rigid-flexible coupling retractable device, the base is fixed on one of the two trapezoidal plates, two ends of one of the two overhead hydraulic cylinders are respectively hinged with the base and one of the two sliders through a first pin shaft and a second pin shaft, one end of the cable-stayed hydraulic cylinder is hinged with the base through a third pin shaft, another end of the cable-stayed hydraulic cylinder is hinged with a middle portion of the long stroke scissor retractable bracket through a fourth pin shaft, the one of the two sliders is rotatably connected with a lower end of the long stroke scissor retractable bracket through the first pin shaft;

the long stroke scissor retractable bracket comprises multiple parallelogram units rotatably connected with each other through multiple rotary shafts, respectively, the L-shaped block is fixed to a rear end of the long stroke scissor retractable bracket, a front end of a rack of the rack and pinion device is fixed with the L-shaped block, a rear end of the rack of the rack and pinion device penetrates through the base and the one of the two trapezoidal plates and is movably placed on one of the two guide support wheels, a pinion of the rack and pinion device is fixed to an output shaft of a rack drive motor, the rack drive motor is installed on the clamp holder, the retractable shaft is a sleeve retractable shaft, two ends of the retractable shaft are respectively fixed with the base and the L-shaped block for allowing cables to pass through;

the parallelogram end removal device comprises two parallelogram rods, a wire brush, a front plate, and an installation bracket, wherein the two parallelogram rods are rotatably connected with the L-shaped block through a first rotation shaft, the two parallelogram rods are able to act together through the first rotation shaft, a second rotation shaft, a third rotation shaft and a fourth rotation shaft, the front plate is installed between the two parallelogram rods, the installation bracket is fixed with the front plate through screws, the removal motor is fixed within the installation bracket, the wire brush is rotatably connected with the removal motor, the wire brush is installed at a left side of the front plate;

the flexible rope transmission device comprises two wire ropes and at least two lock devices, two fifth pin shafts are respectively located at a left side and a right side of the two parallelogram rods, a trough is provided in a middle of each of the two fifth pin shafts, one end of one of the two wire ropes passes through the trough and is rotatably connected with one of the at least two lock devices, another end of the one of the two wire ropes passes through the base and the one of the two trapezoidal plates, and winds around an output shaft of a first winding motor, another end of another of the two wire ropes passes through the base and the one of the two trapezoidal plates, and winds around an output shaft of a second winding motor;

the visual identification system comprises a slider-crank device, two high temperature resistant industrial cameras and a second rigid-flexible coupling retractable device having a same structure with the first rigid-flexible coupling retractable device, wherein:

the second rigid-flexible coupling retractable device is fixed on the front beam;

the slider-crank device comprises a first flexible rope, a second flexible rope, a first connection lever, a second connection lever, a flexible sheave, a visual bracket, a guiding stick, a transverse bar and a two-way guide wheel, wherein the visual bracket is fixed at a front end of a long stroke scissor retractable bracket of the second rigid-flexible coupling retractable device, one end of the first flexible rope and one end of the second flexible rope are fixed at a front end of the flexible sheave, another end of the first flexible rope and another end of the second flexible rope respectively go around an upper wheel and a lower wheel of the two-way guide wheel and wind around an output shaft of a third winding motor and an output shaft of a fourth winding motor; one end of the first connection lever is fixed with the flexible sheave, another end of the first connection lever is rotatably connected with one end of the second connection lever, another end of the second connection lever is rotatably connected with the guiding stick, the guiding stick is installed on the visual bracket, the transverse bar is fixed at an end portion of the visual bracket, and the two high temperature resistant industrial cameras are respectively installed at two ends of the transverse bar.

2. The rigid-flexible coupling-driven robot according to claim 1, wherein an axis of the wire brush, an axis of the hollow shaft and an axis of a forging are always in a same horizontal plane.

3. The rigid-flexible coupling-driven robot according to claim 2, wherein a guide pulley is rotatably located at a hinge shaft in a middle portion of an inner side of the long stroke scissor retractable bracket of the first rigid-flexible coupling retractable device, so as to guide the two wire ropes close to the long stroke scissor retractable bracket.

* * * * *